US006432499B1

(12) United States Patent
Roth et al.

(10) Patent No.: US 6,432,499 B1
(45) Date of Patent: Aug. 13, 2002

(54) NESTED LABEL

(75) Inventors: Joseph D. Roth, Springboro, OH (US); Wayne D. Finster, Viroqua, WI (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/363,602

(22) Filed: Jul. 29, 1999

(51) Int. Cl.[7] ..... B42D 15/00

(52) U.S. Cl. ..... 428/40.1; 283/81; 283/101; 283/105; 428/41.8; 428/42.1; 428/42.2; 428/42.3; 428/43; 428/192; 428/194

(58) Field of Search ..... 428/40.1, 41.8, 428/42.1, 42.2, 42.3, 43, 192, 194; 283/81, 105, 101

(56) References Cited

U.S. PATENT DOCUMENTS

| | | | |
|---|---|---|---|
| 5,279,875 | A | 1/1994 | Juszak et al. |
| 5,501,393 | A | 3/1996 | Walz |
| 5,580,640 | A | 12/1996 | Kraft et al. |
| 5,704,650 | A | 1/1998 | Laurash et al. |

OTHER PUBLICATIONS

Rawlings et al., U. S. application, "Semi–Transparent Label Laminate", filed concurrently herewith (NCR Docket No. 8228).

Roth et al., U. S. application No. 09/114,434, "Label Sheet", filed Jul. 13, 1998 (NCR Docket No. 8066).

Roth et al., U. S. application No. 09/151,000, "Selective Release Label Sheet", filed Sep. 10, 1998 (NCR Docket No. 8133).

Beacon Chemical Company, Inc., "Pattern Adhesive & Release", *Label & Narrow Web Industry*, Mar. 1998, four pages.

Wallace.com, "New Product Announcements", two page website printed May 1999.

FedEx sample label (dated rev. 04/90).

*Primary Examiner*—Nasser Ahmad
(74) *Attorney, Agent, or Firm*—Francis L. Conte

(57) ABSTRACT

A nested label includes a liner having a surface release, and a label removably bonded to the liner by an adhesive. The liner and label have respective die cuts spaced apart from each other at a skip in the liner release for obtaining different bond strengths between the label and liner on opposite sides of the label die cut.

19 Claims, 4 Drawing Sheets

NESTED LABEL

BACKGROUND OF THE INVENTION

The present invention relates generally to labels, and, more specifically, to label-in-labels.

A common pressure sensitive label includes adhesive on its backside which initially removably bonds the label to a release liner. The front side of the label may then be used for any suitable purpose, such as printing mailing addresses thereon. The label is then removed from the liner by peeling therefrom, and reaffixed to a mailer for delivery thereof. The mailer is simply a suitable container, such as an envelope, pouch, or box, and is delivered to the address printed on the label by any suitable carrier such as the post office or express overnight couriers, for example.

A special type of label is referred to as a label-in-label which provides nested labels initially on a common release liner. A typical nested label has a plurality of individual labels defined by die cuts therebetween so that they may be separately removed from the underlying liner. Typically, a large main label adjoins one or more smaller secondary labels on the liner.

The liner is also die cut differently than the labels to define a corresponding main liner supporting the main label, and a secondary liner supporting a secondary label. The secondary liner is typically larger than the secondary label and bridges the main label. In this way, the main liner may be removed from the main label while leaving behind the secondary liner which remains attached to the secondary label and to a portion of the main label. The nested label may then be affixed to the mailer by the pressure sensitive adhesive provided on the back thereof. However, the secondary liner remains with the secondary label and prevents the secondary label from being permanently bonded to the mailer.

During the delivery process, one or more of the secondary labels is provided for subsequent removal for tracking the delivery progress of the mailer. The retained secondary liner permits the individual secondary label to be removed therefrom for reattachment to a tracking sheet, for example, using the adhesive found on the back of the secondary label.

The release liner may have various conventional forms for effecting a weak bond with the adhesive provided on the back of the labels. A typical liner includes a surface release or agent, such as silicone, which forms a weak bond with the pressure sensitive adhesive on the back of the labels and permits their removal therefrom for reattachment to another object.

However, the weak bond between the labels and the liner can permit the inadvertent premature removal of the secondary liner from the secondary label as the main liner is removed from the main label. The secondary liner must remain suitably attached to the secondary label for proper use of the nested label to permit subsequent removal of the secondary label when desired.

Accordingly, it is desired to provide an improved nested label having an integrated secondary liner affixed to the main label.

BRIEF SUMMARY OF THE INVENTION

A nested label includes a liner having a surface release, and a label removably bonded to the liner by an adhesive. The liner and label have respective die cuts spaced apart from each other at a skip in the liner release for obtaining different bond strengths between the label and liner on opposite sides of the label die cut.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
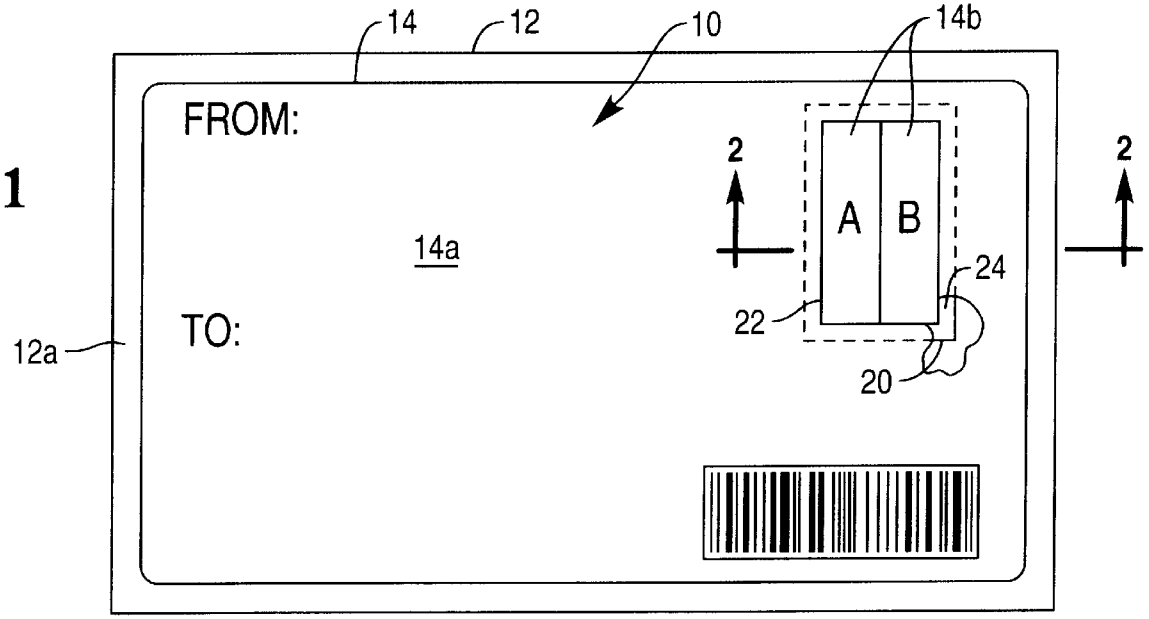
FIG. 1 is a top view of a nested label in accordance with an exemplary embodiment of the present invention.

Illustrated in FIG. 1 is a nested label 10 in accordance with an exemplary embodiment of the present invention. The nested label is an assembly or laminate of a release liner 12 and a label or face sheet 14. The nested label may be formed in any suitable configuration, such as individual sheets of one or more nested labels thereon, or a roll of nested labels as desired.

Figure 2:
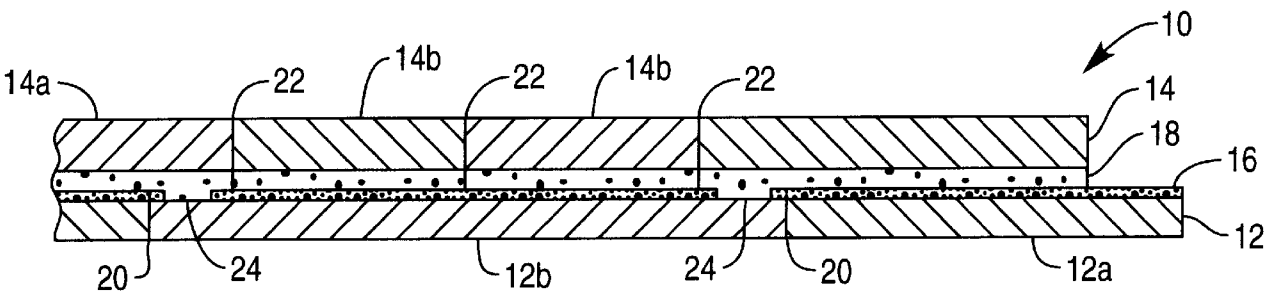
FIG. 2 is a sectional view of a portion of the label illustrated in FIG. 1 and taken along line 2—2.

The nested label may be formed of any conventional components including the release liner 12 and the label 14 joined thereto. FIG. 2 illustrates in section a portion of the nested label wherein the release liner 12 is a sheet of paper or other suitable material having a top surface on which a surface release 16 is disposed. The label 14 is removably bonded to the liner 12 by a suitable pressure sensitive adhesive 18 disposed on the bottom surface thereof which is supported atop the release 16.

The surface release 16 may have any conventional form, such as a silicone release agent disposed atop the underlying liner 12. The release provides a weak bond with the adhesive 18 for initially bonding the label 14 to the liner 12, and permits the removal thereof with the adhesive remaining with the label 14 as it is peeled away from the liner. Such pressure sensitive label construction is conventional.

However, and in accordance with an exemplary embodiment of the present invention, the liner 12 and label 14 have respective die cuts 20,22 laterally spaced apart from each other at a skip 24 in the liner release 16 for obtaining different bond strengths between the label and liner on opposite sides of the liner die cut 20.

In a preferred embodiment, the skip 24 is devoid of the release 16 which directly exposes the underlying liner 12 to the adhesive 18 for forming a substantially permanent bond therewith. in this way, the release skip 24 effects a greater bond between the adhesive 18 and the liner 12 at the skip 24 itself than away therefrom without the skip. If desired, the skip 24 may be tailored to otherwise vary the bond strength between the adhesive 18 and the liner 12, by using a locally different release agent thereat for example.

The skip 24 illustrated in FIG. 2 permits a portion of the label 14 to remain securely attached to the liner 12 while other portions of the label may be peeled away therefrom due to the weak bond provided by the release 16. This effect has particular utility when the label 14 illustrated in FIG. 1 is segmented or partitioned into a large main label 14*a* adjoining one or more smaller secondary labels 14*b* at corresponding label die cuts 22. The skip 14 is preferably disposed directly below or in line with a corresponding portion of the main label 14*a* as additionally shown in FIG. 2.

Correspondingly, the liner 12 is also segmented or partitioned into a large main liner 12*a* adjoining a smaller secondary liner 12*b* at the liner die cut 20 as illustrated in FIGS. 1 and 2. The skip 24 is disposed directly above or in line atop the secondary liner 12*b* and preferably around its perimeter. In this way, the skip 24 bridges the secondary liner 12*b* around its perimeter to the main label 14*a* around the perimeter of the secondary labels 14*b*. The secondary liner 12*b* is thusly securely bonded to the main label by the adhesive 18 along the skip 24.

As illustrated in FIG. 2, the label and liner die cuts 20,22 extend through the corresponding label and liner sheets or plies to the liner release 16. And, the skip 24 is spaced laterally between the label and the liner die cuts to ensure a strong bond between the label and liner at the skip, with weak bonds between the label and liner at the die cuts over the liner release 16.

As shown in FIGS. 1 and 2, the secondary labels 14*b* are severed from the main label 14*a* by the label die cut 22 for isolating the main and secondary labels from each other and permitting removal of the individual secondary labels from the main label without tearing or damage.

Correspondingly, the main liner 12*a* is severed from the secondary liner 12*b* by the liner die cut 20 for isolating the main and secondary liners from each other to permit removal of the main liner 12*a* without tearing or damage thereto, and without liberating the secondary liner 12*b* from the main label.

In the preferred embodiment illustrated in FIGS. 1 and 2, a plurality of the secondary labels 14*b* adjoin each other and adjoin the main label 14*a* at respective ones of the label die cuts 22. Two exemplary secondary labels are illustrated, although a single one of such labels may also be used.

Also in the preferred embodiment illustrated in FIGS. 1 and 2, the two secondary labels 14*b* adjoin each other at a respective one of the label die cut 22, and are collectively disposed atop a unitary or common one of the secondary liner 12*b*.

The skip 24 therefore surrounds the common secondary liner 12*b* and bridges that secondary liner around its perimeter to the main label 14*a* to provide a secure attachment therebetween. The skip 24 preferably surrounds the common secondary liner 12*b* on all four sides thereof. However, no skip is provided below the label die cut 22 between the two secondary labels 14*b* to permit their easy removal.

This exemplary construction of the nested label 10 illustrated in FIGS. 1 and 2 enjoys substantial benefits over a conventional label-in-label construction. For example, the main and secondary labels illustrated in FIG. 1 may be preprinted or post-printed with any suitable information such as addresses for the recipient and sender contained on the main label 14*a*, for example. A tracking barcode may also be provided on the main label. One or more of the secondary labels 14*b* may have suitable tracking information printed thereon such as serial numbers for example, represented by the letters A and B.

Figure 3:
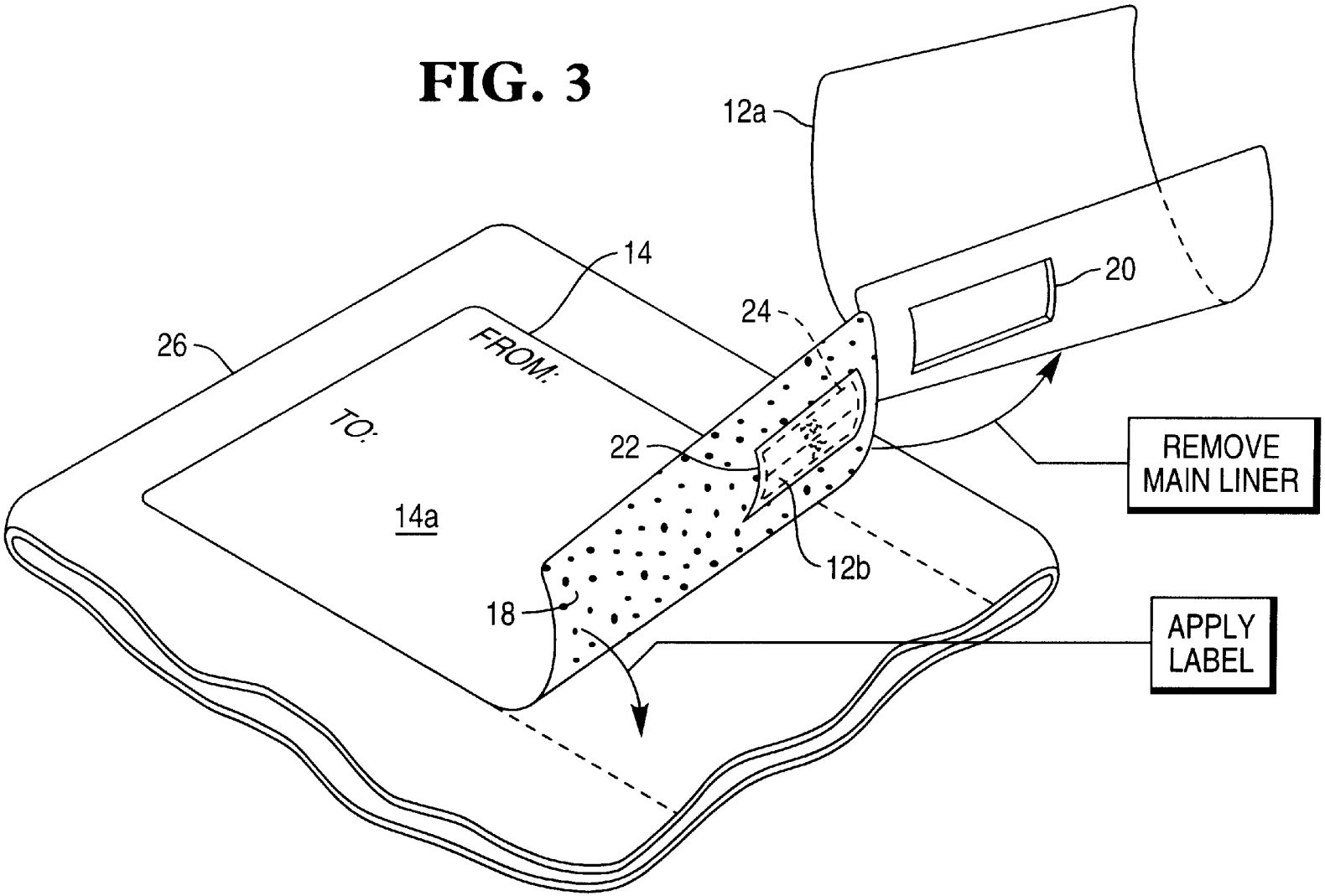
FIG. 3 is an isometric view of the label illustrated in FIG. 1 being applied to an exemplary mailer.

As shown in FIG. 3, the main liner 12*a* is removed from the nested label by being peeled away therefrom so that the remaining label may then be affixed atop a suitable mailer 26, shown in part, for use in delivery to an intended recipient. The mailer 26 may have any conventional form such as an envelope, pouch, box, or other shipping container, and may be shipped by mail or overnight express couriers, for example.

Upon removal of the main liner 12*a*, the pressure sensitive adhesive 18 behind the main label 14*a* is exposed and provides a permanent bond with the mailer 26 after the label is applied thereon.

However, the liner die cut 20 surrounding the secondary liner 12*b* allows the main liner 12*a* to be removed from the main label 14*a* without removing the secondary liner 12*b*. The release skip 24 ensures that the secondary liner 12*b* remains firmly attached to the main label 14*a* for ensuring integrity of the secondary labels 14*b*, shown in more particularly in FIG. 4.

Figure 4:
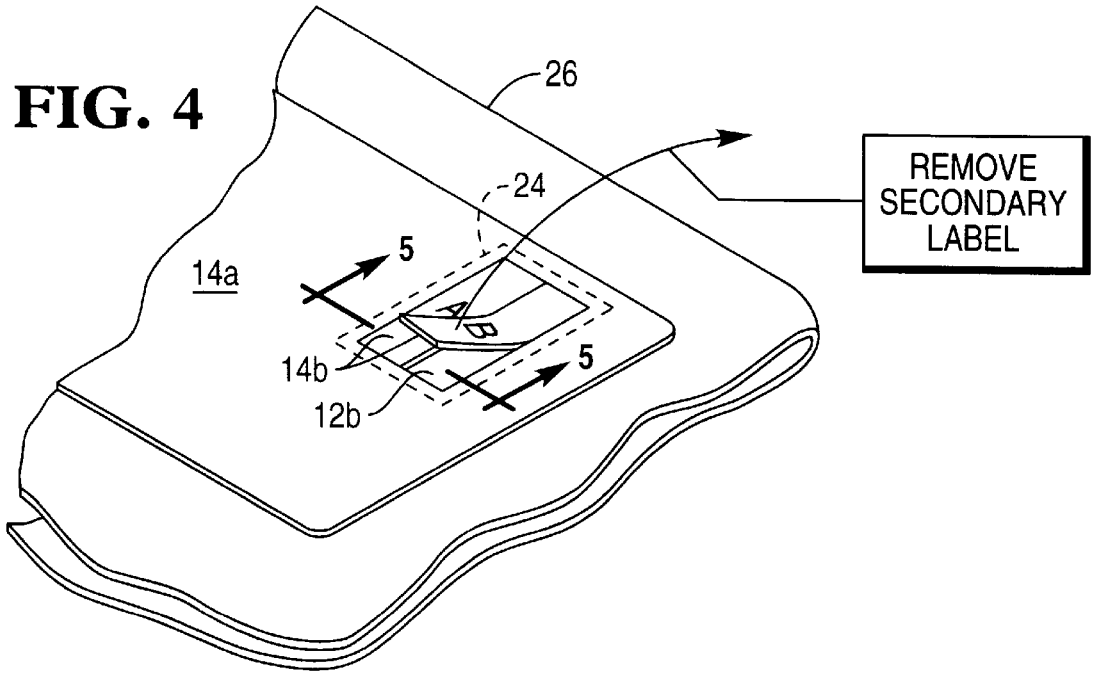
FIG. 4 is an isometric view of the label illustrated in FIG. 3 attached to the mailer, with a secondary label being removed therefrom.
Figure 5:
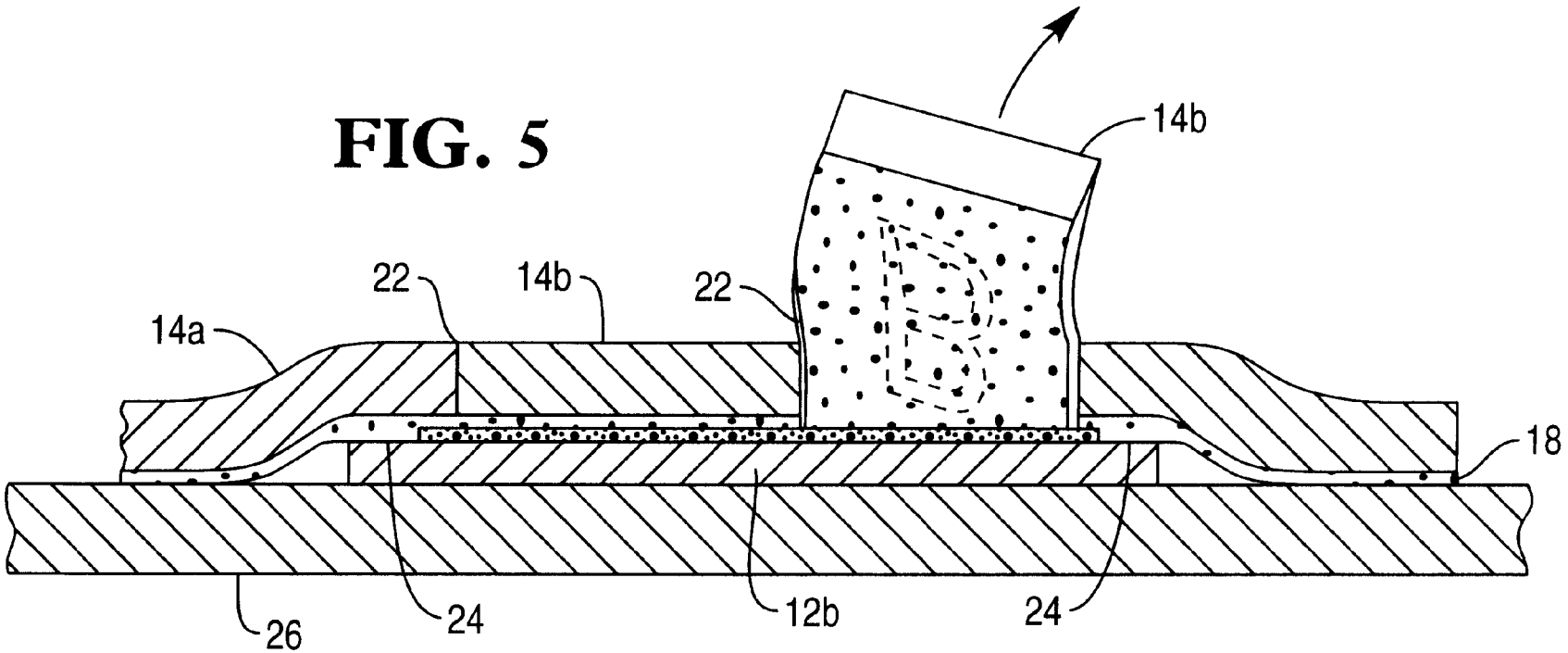
FIG. 5 is a sectional view of a portion of the attached label illustrated in FIG. 4 and taken along line 5—5.

As shown in FIG. 4 and 5, the adhesive 18 permanently bonds the main label 14*a* atop the mailer 26. The secondary liner 12*b* is thusly trapped between the main label and the mailer 26. The individual secondary labels 14*b* may then be removed as desired by simply being peeling away from the secondary liner 12*b*.

Although such use of a label-in-label configuration is conventional in tracking the delivery of a mailer, the improved construction of the nested label 10 maintains integrity of the secondary liner 12*b* and the main label 14*a*. The premature release of the secondary liner 12*b* is eliminated. And, the premature liberation of the secondary labels 14*b* is also eliminated since they remain attached to the underlying secondary liner 12*b* integrated with the main label 14*a*.

The selectively introduced skip 24 in the silicone release 16 may be effected in any suitable manner. For example, a silicone release may be applied or printed over the entire top surface of the liner 12 except at the desired locations of the skip 24. A liquid silicone release may be cured by ultraviolet (UV) light to complete the release liner. If desired, the composition of the silicone release may be varied for changing the release force between the main and secondary labels as desired. For example, the secondary labels may have a stronger or tighter bond with the secondary liner than the bond of the main label with the main liner.

Figure 6:
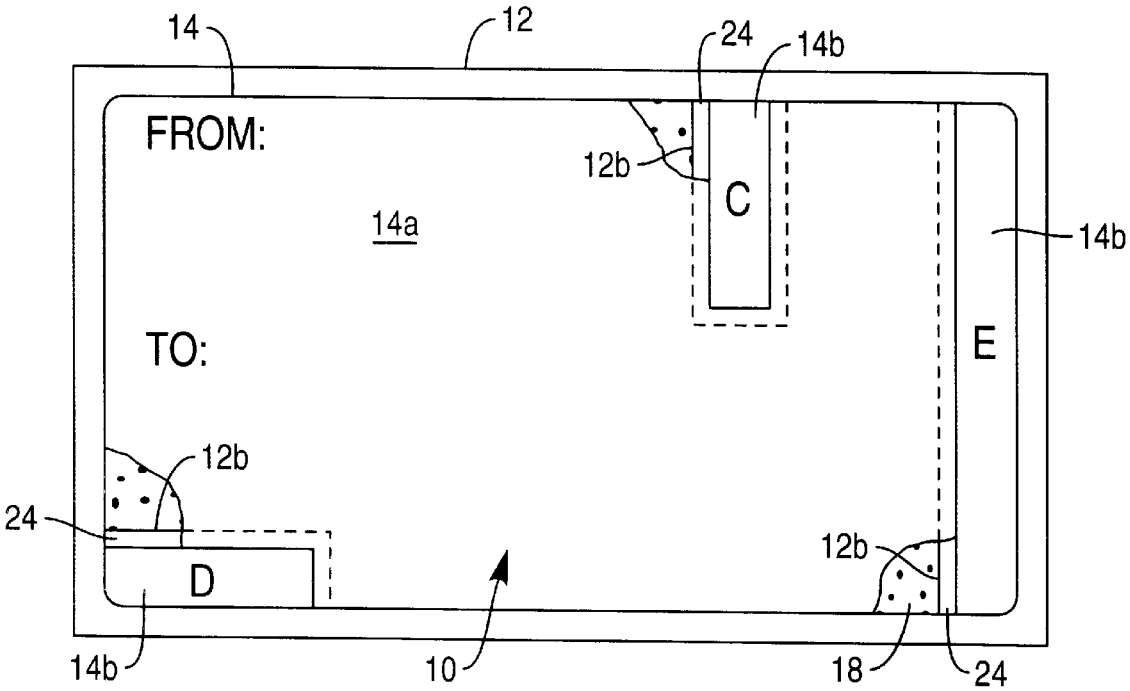
FIG. 6 is a top view of a nested label in accordance with additional embodiments of the present invention.

FIG. 6 illustrates an alternate embodiment of the nested label 10 including various forms of the secondary labels 14*b*, and corresponding secondary liners therebelow. In one embodiment, the secondary label 14*b*, identified by the letter E printed thereatop, adjoins the main label 14*a* as an end-strip along a single edge of the secondary label, with the three remaining edges thereof being exposed and defining a part of the entire perimeter of the label 14. The skip 24 extends along the single adjoining edge of the secondary label to bridge the secondary liner 12*b* to the main label 14*a*.

FIG. 6 also illustrates another secondary label 14*b*, designated by the letter D printed thereon, adjoining the main label 14*a* along only two edges of the secondary label to define a corner label, with the remaining two edges being exposed. The skip 24 correspondingly extends along both internal edges of the secondary label to bridge the secondary liner 12*b* to the main label 14*a*.

FIG. 6 further illustrates another secondary label 14*b* identified by the letter C printed thereon adjoining the main label 14*a* along only three edges of the secondary label, with an exposed fourth edge along the perimeter of the label 14. The corresponding skip 24 extends along the three internal edges of the secondary label to bridge the secondary liner 12*b* to the main label 14*a* on three sides.

In FIG. 6, the three exemplary secondary labels all have one or more exposed edges defining a portion of the perimeter of the entire label 14. In FIG. 1, the one or more secondary labels 14*b* are surrounded around the external perimeter thereof by the main label 14*a*. And, the skip 24 surrounds the secondary liner 12*b* to bridge the secondary liner to the main label.

In all of the above embodiments disclosed, the secondary liner 12*b* remains firmly attached to the main label 14*a* by the adhesive at the corresponding skip. The main liner 12*a* may then be readily removed from the main label without removing the secondary liner 12*b* therefrom. The main label may then be applied to a mailer trapping the secondary liner 12*b* atop the mailer. And, the secondary label may be individually removed from the secondary liner when desired, such as in the tracking example disclosed above.

The improved nested label-in-label construction disclosed above may be used wherever desired. The nested label may have various configurations according to the particular application therefor.

Accordingly, what is desired to be secured by Letters Patent of the United States is the invention as defined and differentiated in the following claims.

What is claimed is:

1. A nested label comprising:

a liner having a surface release and a liner die cut;

a label removably bonded to said liner by an adhesive, and said label includes a main label directly adjoining a secondary label at a label die cut; and said liner and label die cuts are laterally spaced apart from each other at a skip in said surface release being disposed below said main label for obtaining different bond strengths between said label and liner on opposite sides of said liner die cut.

2. A nested label according to claim 1 wherein:

said liner comprises a main liner adjoining a secondary liner at said liner die cut; and said skip is disposed above said secondary liner.

3. A nested label according to claim 2 wherein said skip effects a greater bond between said adhesive and liner thereat than away therefrom.

4. A nested label according to claim 3 wherein said skip is devoid of said release.

5. A nested label according to claim 3 wherein:

said label and liner die cuts extend to said release; and said skip is spaced between said die cuts.

6. A nested label according to claim 3 wherein:

said secondary label is severed from said main label by said label die cut for removal therefrom; and said main liner is severed from said secondary liner by said liner die cut for removal therefrom.

7. A nested label according to claim 3 further comprising a plurality of said secondary labels adjoining said main label at respective ones of said label die cuts.

8. A nested label according to claim 7 wherein said secondary labels adjoin each other at a respective one of said label die cut, and are disposed atop a common one of said secondary liner.

9. A nested label according to claim 8 wherein said skip bridges said common secondary liner to said main label.

10. A nested label according to claim 9 wherein said skip surrounds said common secondary liner.

11. A nested label according to claim 3 wherein said secondary label adjoins said main label along a single edge, and said skip extends therealong to bridge said secondary liner to said main label.

12. A nested label according to claim 3 wherein said secondary label adjoins said main label along only two edges, and said skip extends along both edges to bridge such secondary liner to said main label.

13. A nested label according to claim 3 wherein said secondary label adjoins said main label along only three edges, and said skip extends therealong to bridge said secondary liner to said main label.

14. A nested label according to claim 3 where said secondary label is surrounded by said main label, and said skip surrounds said secondary liner to bridge said secondary liner to said main label.

15. A nested label comprising:

a main liner directly adjoining a secondary liner at a liner die cut, and having silicone on surfaces thereof;

a main label directly adjoining a secondary label at a label die cut, and having adhesive on surfaces thereof supported atop said silicone; and said liner and label die cuts being laterally spaced apart from each other at a skip in said silicone for fixedly bonding said secondary liner to said main label by said adhesive.

16. A nested label according to claim 15 wherein said skip is spaced between said die cuts and is devoid of said silicone, and said die cuts are disposed atop said adhesive.

17. A nested label according to claim 16 wherein:

said secondary label is severed from said main label by said label die cut for removal therefrom; and said main liner is severed from said secondary liner by said liner die cut for removal therefrom.

18. A nested label according to claim 17 wherein said main label surrounds said secondary label around the perimeter thereof.

19. A nested label according to claim 17 wherein said secondary label has an exposed perimeter edge without said skip.

* * * * *